US007887257B2

(12) United States Patent
Shaw et al.

(10) Patent No.: US 7,887,257 B2
(45) Date of Patent: Feb. 15, 2011

(54) DRAIN SEALING DEVICE

(76) Inventors: Mark D. Shaw, 196 S. Roscoe Blvd., Ponte Vedra Beach, FL (US) 32082; J. Tad Heyman, 659 Ocean Blvd., Atlantic Beach, FL (US) 32233

( * ) Notice: Subject to any disclaimer, the term of this patent is extended or adjusted under 35 U.S.C. 154(b) by 70 days.

(21) Appl. No.: 11/640,806

(22) Filed: Dec. 18, 2006

(65) Prior Publication Data

US 2008/0145150 A1 Jun. 19, 2008

(51) Int. Cl.
*E02B 3/16* (2006.01)

(52) U.S. Cl. ..... 405/52; 404/2; 404/25; 4/293

(58) Field of Classification Search ..... 405/36, 405/52; 404/2, 25, 26; 4/293
See application file for complete search history.

(56) References Cited

U.S. PATENT DOCUMENTS 3,474,625 A 10/1969 Draper et al.
4,838,732 A 6/1989 Clark et al.
4,988,234 A * 1/1991 Henkel et al. ..... 405/36
5,763,067 A * 6/1998 Bruggemann et al. .... 428/317.9
6,338,168 B1 * 1/2002 Valentine ..... 4/293
6,530,722 B1 3/2003 Shaw et al.
6,586,080 B1 * 7/2003 Heifetz ..... 428/198
6,769,834 B1 * 8/2004 Stange ..... 404/25
6,821,587 B2 * 11/2004 Forbes et al. ..... 428/34.2
2003/0053862 A1 * 3/2003 Shaw et al. ..... 405/40
2005/0262624 A1 * 12/2005 Evans et al. ..... 4/293

* cited by examiner

*Primary Examiner*—David J Bagnell
*Assistant Examiner*—Benjamin Fiorello
(74) *Attorney, Agent, or Firm*—Thomas C. Saitia

(57) ABSTRACT

A multiple layer drain seal device for rapidly sealing the apertures in a drain grate, the drain seal having a lower sealing layer and an upper protective cover layer, the lower sealing layer being separable from the upper protective cover layer except at discrete attachment points, wherein the lower sealing layer is softer, more flexible and has lower shear resistance than the upper protective cover layer, such that the lower sealing layer sags into the drain grate apertures but the upper protective cover layer does not.

24 Claims, 2 Drawing Sheets

DRAIN SEALING DEVICE

BACKGROUND OF THE INVENTION

This invention relates to devices used to cover or seal storm drain grates or similar apertured drain members when it is desired to prevent liquids from passing through the grates into the drain system. More particularly, the invention relates to such devices which comprise liquid impermeable mats or sheets composed of polymeric materials, where the mats are simply placed onto the top of the grates to close off the openings.

Drainage systems for removing liquids from an area are well known, and may comprise for example storm drain systems for removing rain water from roads and parking lots or interior drain systems provided in the floors of warehouses and other buildings. In many such systems the drain system comprises an interconnected network of pipes or other conduits which receive water flowing through surface mounted drains and deliver the water to a reservoir or tank, or deliver the water to a remote exterior location for release. The drains are usually provided with an apertured grate, such that liquids will freely pass through the grate but large objects will be precluded from entering in order to prevent blockage of the drain system, lost objects and accidental injury. The grates are of many configurations and may be rectangular, square, circular, etc., and the individual openings or apertures in the grates themselves may be of many shapes, such as circular, square, rectangular, etc., as there is no uniform or standard configuration within the industry.

Under certain circumstances it is desirable to quickly seal the drains such that liquid does not pass into the drain system, since in many instances the drain systems simply release liquids into the environment at remote or controlled local locations. For example, it may be necessary to temporarily seal the drains when pollutants or hazardous material spills occur, due for example to tanker truck accidents, pipe or liquid container failures, etc., in order to prevent the hazardous liquid from passing into the drain system and out into the environment. It is known to provide mechanical valves or custom fitted caps which correspond to a particular grate design, but these solutions are not viable in many circumstances, such as with outdoor storm drain systems where various designs of grates may be encountered, and are not particularly suitable in emergency situations where an immediate response is required. It is more practical to have a drain seal which operates in a universal and simple manner, such that a large variety of grates can be quickly and effectively sealed by response personnel without the need to match a particular grate or to undertake excessive, time-consuming connection steps.

To this end drain sealing devices have been developed which comprise in general a sheet or mat composed of a flexible polymeric or elastomeric material, the material being impermeable to liquids and highly chemical resistant, such that the drain can be sealed by placing a mat directly on, top of the grate, where the mat's outer dimensions extend beyond the outer edges of the grate. Such sealing devices may be composed of polyurethane, PVC, silicone or other polymers possessing appropriate properties.

One example of such a sealing device is a drain seal sold commercially under the brand name DRAINBLOCKER by New Pig Corp., which comprises a flexible, two-layer, polyurethane mat having a thin upper structural layer made of polymer coextensively joined to a thicker lower sealing layer made of polymer, where the upper structural layer is denser, less elastic, and less flexible than the lower layer. The lower sealing layer is somewhat tacky and is provided on the underside with a thin, removable cover layer which is removed prior to use. In use, the soft lower layer conforms and seals against the grate and the surrounding frame, roadway or floor slab such that liquids cannot pass beneath the drain seal and into the drain. The upper structural layer is provided to impart strength and increased rigidity to the lower layer, and to prevent tearing during handling. Such a drain seal suffers from several inherent weaknesses, including the need to provide a removable cover layer to prevent undesirable adhesion to other mats and other objects during storage, and to prevent accumulation of debris, dust, sand and other particulate matter on the soft lower layer prior to use, which cover layer needs to be reapplied to the sealing device after it is cleaned for reuse. Another drawback is the coextensive upper structural layer impedes the sealing efficiency of the soft lower layer. Another drawback is the problem of incorrect use of the sealing device, since response personnel may easily invert the device in an emergency response such that the structural layer is mistakenly placed directly against the grate rather than the softer sealing layer, in which case the drain may not be properly sealed. In addition, larger mats of this design are subject to tearing because of the lack of internal structure or reinforcement, such that a small tear in the perimeter rapidly passes through the entire mat during handling.

Another example of a sealing device in the form of a mat is shown in U.S. Pat. No. 4,988,234 issued to Henkel et al. This device is similar to the New Pig device described above and comprises a flexible two-layer mat where the thin upper layer is denser and less elastic than the lower layer. The upper layer is shown to comprise a silicon rubber and the lower layer is described as a molding composition which comprises a highly viscous, sticky, silicone gel. The sealing device must remain sealed in an air-tight package until needed for use. The gel cures from a plastic state into an elastic state when exposed to moisture in the atmosphere, such that when the device is placed onto a grate to prevent liquid passage into the drain system, the lower gel layer freely flows to enter and fill the grate apertures, whereupon it quickly cures to adopt a configuration particular to that grate. Such a sealing device is therefore not reusable and is difficult to handle during emergency situations, since the device must first be removed from the air-tight packaging, and is likewise susceptible to tearing and failure due to the lack of internal reinforcing structure, as well as inversion by inexperienced personnel.

Still another example of a drain sealing device is the sealing mat of U.S. Pat. No. 4,838,732 issued to Clark et al. This device comprises a core elastomer having low shear resistance and high flow characteristics, with the core elastomer being encased in a flexible, thin-film, liquid impermeable envelope, which may be open or sealed on the edges. Drawbacks to this device include the tendency of the flowable core elastomer to bottom out during storage due to gravity effects, such that the core elastomer may be unevenly distributed within the device unless the device is stored in a flat position. Also, since the envelope material contacts the ground and grate surfaces rather than the softer core elastomer, there is less adhesion and a greater likelihood that liquid flowing against the mat will lift the edges of the mat and enter the drain system. As with the other sealing devices described above, there is no reinforcing structure, such that the mat is susceptible to tearing and failure.

Another example of a drain sealing device is shown in our U.S. Pat. No. 6,530,722, which shows a sealing mat composed of a polymeric material and having an internal reinforcing scrim or similar reinforcement members disposed internally. The polymeric material has a sufficient minimum amount of creep or flexibility such that all of the apertures in the grate are well sealed by contact with the underside of the device, while the reinforcing material adds structural integrity and durability to the device. A drawback to this device is that the exposed upper surface is susceptible to damage from vehicular traffic.

It is an object of this invention to address and overcome the problems and drawbacks inherent in the known mat-type drain sealing devices by providing a drain sealing mat device which is a multi-layer mat, one layer being composed of polymeric material, where the semi-rigidity of the polymeric material provides a suitable amount of creep or sag such that the layer will conform to the apertures in the grate to be sealed without such creep or sag being excessive, and with the other layer being composed of a polymeric material of different properties, this upper layer being more rigid and durable so as to provide protection to the lower layer, with the layers not joined coextensively but instead connected at a relatively small number of discrete points or regions such that the creeping or sagging of the lower layer is not impeded or restrained by the non-creeping upper layer. These objects and other objects not expressly stated will be made evident upon examination of the disclosure which follows.

SUMMARY OF THE INVENTION

The invention is in general a drain sealing device for temporarily blocking and sealing a surface-mounted, apertured drain member disposed, for example, on the ground, in the curb adjacent a paved road, within a parking lot, or in the floor of a structure. Such drain systems are well known, typically comprising a removable, apertured grate member disposed atop a downwardly oriented pipe, conduit or concrete body, such that any liquid entering the drain is conducted from the ingress location through the drain system to a point of disposal or treatment. Storm water drains in roadways and parking lots or liquid removal systems in the floors of warehouses are examples of such drain systems. The sealing device of the invention is a multi-layer mat formed of polymeric material which can be quickly placed over the drain grate with the edges of the mat extending beyond the grate such that all grate apertures are covered by the mat.

The drain sealing device comprises a lower layer composed of a polymeric material of relatively low hardness and high flexibility, such as a polyurethane elastomer, such that the lower layer may slightly bend, creep, seep or sag under the effects of gravity into the apertures of the storm grate. The polymeric material forming the sealing layer has a sufficient minimum amount of creep or flexibility such that all of the apertures in the grate are well sealed, yet is sufficiently durable and of suitable hardness for handling and storage purposes. An upper layer is provided, the upper layer being composed of a polymeric material of much greater durability and hardness, such as a PVC, such that there is little to no creep or sag, and such that the upper layer provides protection to the lower sealing layer from damage which may occur from vehicle tires or the like. The upper layer also provides UV protection for the lower layer, since the softer polymer material of the lower layer is highly susceptible to UV damage over time. The upper protective layer is not coextensively attached or bonded to the lower layer, but is instead attached at a small number of discrete points or areas by mechanical fasteners, adhesives, stitching, heat sealing or the like, such that the creep or sag of the lower layer is not impeded or restricted by the greater rigidity of the upper layer.

Additional layers may be added if desired, and the attachment means may be such as to allow the lower sealing layer to be reversed relative to the upper protective layer and/or replaced. In addition, the upper surface of the upper layer may be provided with anti-slip means to increase traction, such as raised or embossed structural features, embedded abrasive particles or the like.

DETAILED DESCRIPTION OF THE INVENTION

Figure 1:
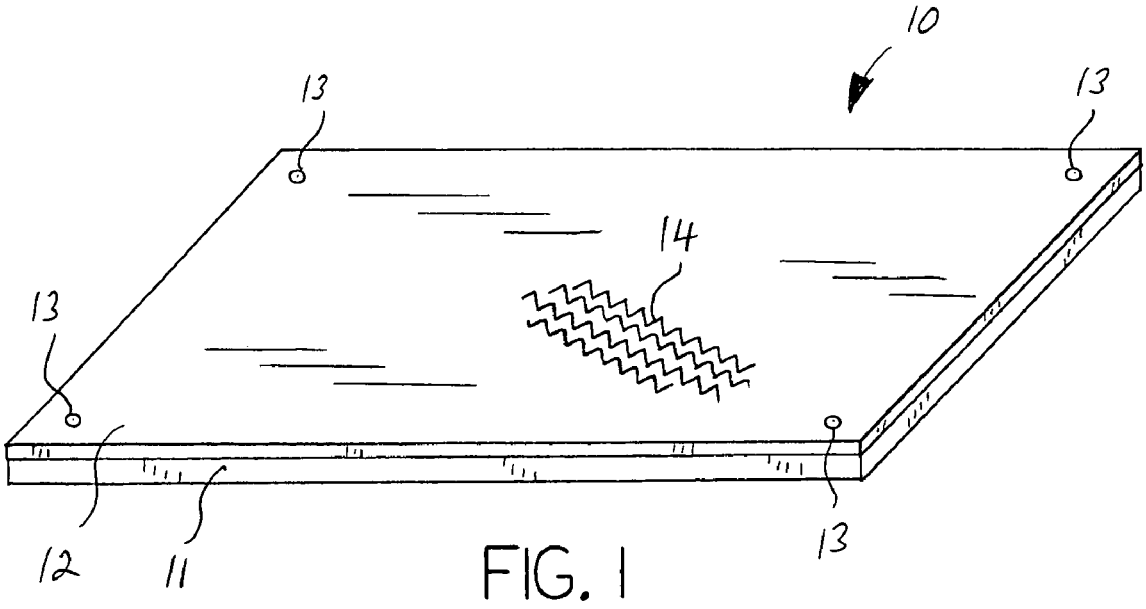
FIG. 1 is a perspective view of the drain sealing device comprising the invention.

With reference to the drawings, the invention will now be described in detail with regard for the best mode and the preferred embodiment. In general, the invention is a drain sealing device comprising a multiple layer mat or sheet-like device having a relatively thin vertical dimension as compared to its horizontal dimensions. The perimeter or edge configuration of the drain sealing device may be rectangular, square, round, oblong or any other desired shape. The invention is preferably composed of polymeric materials. The drain seal device is utilized by placing it directly on top of a drain grate such that all apertures in the drain grate are covered by the invention.

As shown in the figures, the invention is a multi-layer drain seal device 10 in the form of a mat and comprises a lower sealing layer 11 and an upper protective cover layer 12, the two layers 11 and 12 being joined by attachment means 13. The lower sealing layer 11 is composed of an elastomeric polymer, such as for example, polyurethane, silicone or the like, that is relatively soft, flexible, plastically deformable and with low shear resistance, such that the lower sealing layer 11 possesses the ability to sag, creep or flow slightly under small amounts of pressure or due simply to gravity effects. This characteristic optimizes the sealing efficiency of the lower layer 11, since portions of the lower layer 11 corresponding to the apertures, slots or holes 94 in the grate 93 will creep or sag into the open space, creating a better seal along the edges of the apertures 94 to prevent intrusion of water or other liquids. The exposed undersurface of the lower sealing layer 11 also preferably possesses a slight tackiness, which also acts to increase the sealing efficiency between the lower sealing layer 11 and the grate 93.

The upper protective cover layer 12 is a polymer material chosen or processed to have different characteristics from the lower sealing layer 11. The upper protective cover layer 12 is less flexible than the lower sealing layer 11 and is much harder, more durable and with higher shear resistance. Preferably the upper protective cover layer 12 is composed of a polymer different from the polymer composing the lower sealing layer 11, such as for example a PVC, to insure that attraction between the two layers is minimized or precluded, whether such attraction is due to electrostatic, chemical bonding, or mechanical effects. It is critical to the invention that the upper protective cover layer 12 and the lower sealing layer 11 not be coextensively bonded, coextensively laminated or otherwise coextensively joined, such that any of the desirable creep and sag properties of the lower sealing layer 11 are not impeded or restricted by the non-creeping and non-sagging upper protective cover layer 12.

To this end, the upper protective cover layer 12 is joined to the lower sealing layer 11 by attachment means 13 only at a minimal number of discrete points or over minimal areas relative to the entire common surface areas of the two layers, such that while the upper surface of the lower sealing layer 11 contacts the lower surface of the upper protective cover layer 12, the two layers 11 and 12 are separable except at the location of the attachment means 13. The attachment means 13 may comprise mechanical fasteners, such as nuts and bolts, staples, rivets to the like, that pass through both layers 11 and 12, or may comprise stitching, or may comprise discrete points or areas of adhesive bonding or melt bonding. For example, the two layers 11 and 12 may be joined by attachment means 13 consisting of two mechanical fasteners positioned near opposing corners. Alternatively, the attachment means 13 may comprise short points or segments of stitching, or one or more lines of stitching adjacent an edge of the device 10. Alternatively, the attachment means 13 may comprise short points or segments of bonding means, or one or more lines or small areas of bonding means adjacent an edge of the device 10. By utilizing a minimal number of attachment means 13, the lower sealing layer 11 is free to flow, sag or creep over the majority of its surface in order to better seal the apertures 94 of the grate 93, regardless of the size, shape or location of the apertures 94. Most preferably, attachment means 13 are such that they provide releasable attachment of the lower sealing layer 11 to the upper protective cover layer 12 such that the lower layer 11, which will likely wear out sooner than the upper protective cover layer 12, may be readily reversed to expose its other surface or completely replaced if needed.

The upper protective cover layer 12 provides protection from UV degradation in addition to protection from physical damage. The upper surface of the upper protective cover layer 12 may be provided with anti-slip traction members 14, such as depressions or protrusions, embedded particles, or the like. The upper protective cover layer 12 is also preferably of slightly greater size in the horizontal directions, such that it overlaps the edges of the lower sealing layer 11.

Figure 3:
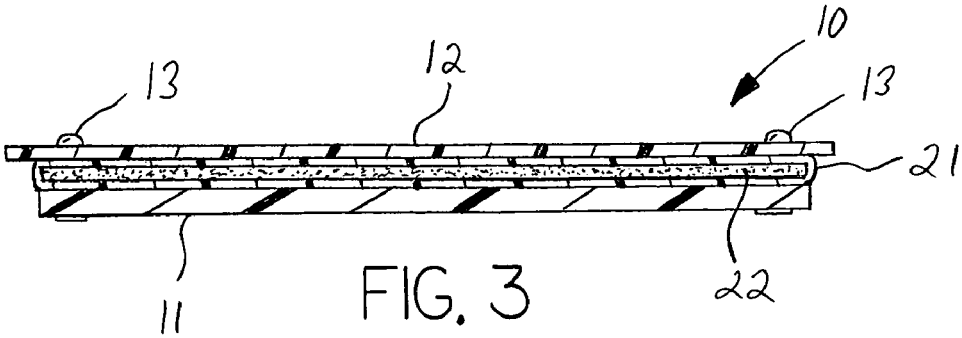
FIG. 3 is a cross-sectional view of an alternative embodiment of the invention showing an intermediate layer.

An alternative embodiment, as shown in FIG. 3, includes an intermediate layer 21 disposed between the upper protective cover layer 12 and the lower sealing layer 11. The intermediate layer 21 may serve to add weight to the drain seal device 10, may be provided as an additional separation layer, or may be an absorptive layer. In an embodiment suitable for adding weight to the device 10, the intermediate layer 21 may be formed as an envelope carrying a filler material 22, such as sand or water. While the intermediate layer 21 may be coextensively bonded to the upper protective cover layer 12, it is not coextensively bonded or joined to the lower sealing layer 11, instead being connected only at discrete points or small areas as previously described such that the creep or sag of the lower sealing layer 11 is not impeded or restricted.

Figure 2:
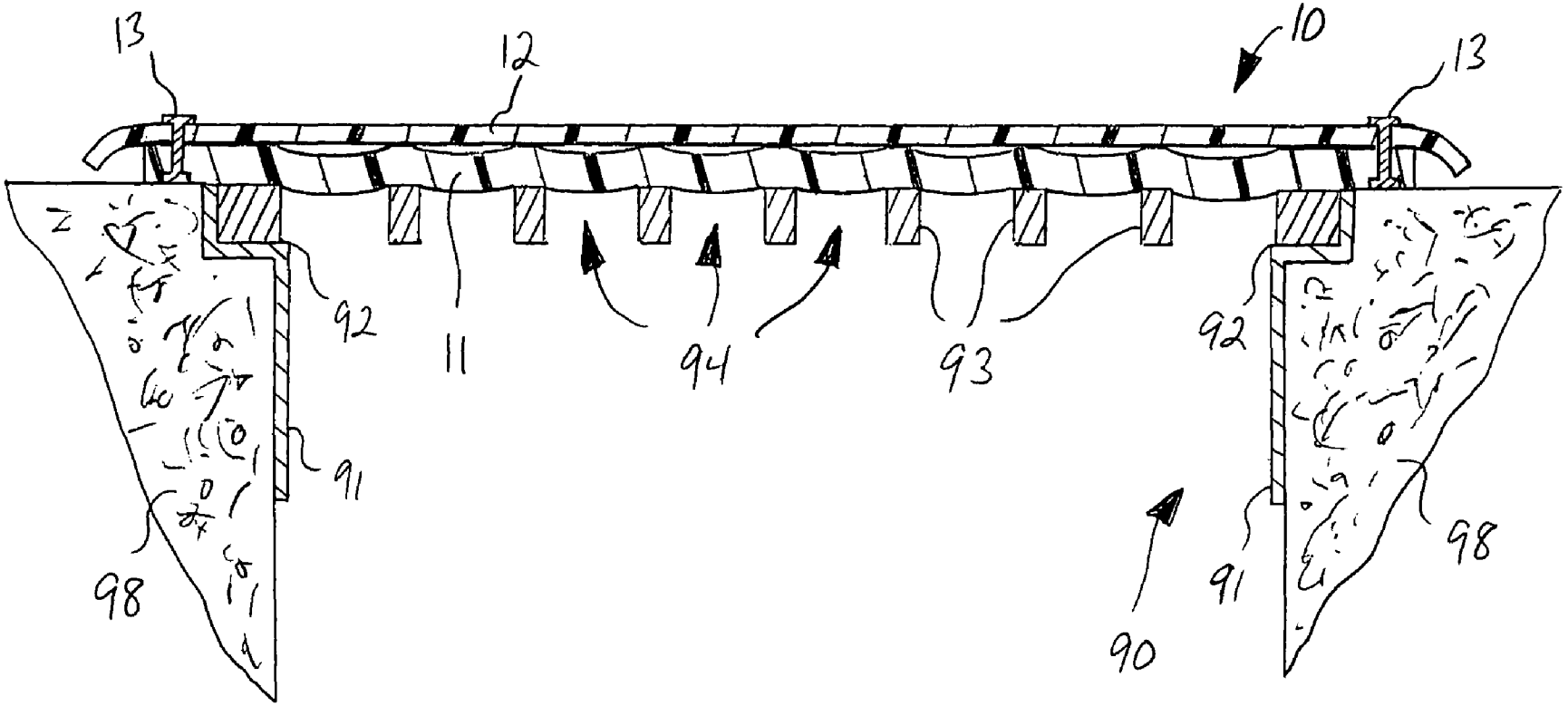
FIG. 2 is a cross-sectional view of the invention showing it in use to block a storm drain grate and showing the lower sealing layer of the invention as separated from the upper protective layer and sagging into the grate apertures to maximize the sealing effect.

An illustration of the drain sealing device 10 in use is provided in FIG. 2. The drain seal device 10 comprises an upper protective cover layer 12 that slightly overhangs the lower sealing layer 11, which are connected to each other at discrete points by attachment means 13, shown here as mechanical fasteners. The drain sealing device 10 is placed atop the drain assembly 90, which as illustrated here comprises a metal drain body 91 having a shoulder 92 to receive a drain grate 93 having apertures 94 for liquid passage. The drain body 91 and grate 93 are shown disposed within a concrete slab 98, which could be part of the floor of a building, a parking lot, a road, etc. The drain seal 10 is disposed such that the lower sealing layer 11 directly contacts the drain grate 93, and the size of the drain seal 100 is such that its perimeter extends beyond all sides of the grate 93. The sealing effect of the drain seal 10 thereby prevents passage of water through the drain assembly 90. In order to effect a proper seal to completely close off the drain apertures 94, it is necessary that the lower sealing layer 11 polymer composition possess a small amount of creep, sag, compressibility and flexibility, such that the lower sealing layer 11 in contact with the grate 93 will slightly deform within the apertures 94 and the lower sealing layer 11 in contact with the concrete slab 98 will slightly deform to surface variations in the slab 98 to provide a complete peripheral seal. For example, when the sealing drain 10 is placed across a three inch wide opening, it is preferable that the lower sealing layer 11 sag at least one sixteenth of an inch. Likewise, when the drain seal 10 is disposed on a three quarter inch high raised shoulder above a planar base surface, it is preferable that the lower sealing layer 11 contact the base surface within three inches of the shoulder. In addition, while the lower sealing layer 11 may be slightly tacky, it is preferable that this be minimized such that the device 10 can be stored without extra precautions, such as a removable underside cover layer, to prevent adhesion to other sealing devices 10 or other objects and to minimize adhesion of dirt, sand and other particulates, thereby allowing the devices 10 to be easily cleaned and reused. It is most preferable that the tackiness of the sealing surfaces 11 and 12 be such that less than four grams of 100 grit abrasive particles, such as CARBORUNDUM brand abrasive particles, adhere per square inch when the sealing surface 11 or 12 is contacted with a coextensive expanse of loose 100 grit abrasive particles, such as CARBORUNDUM brand abrasive particles.

It is contemplated that equivalents and substitutions to certain elements set forth above may be obvious to those skilled in the art, and thus the true scope and definition of the invention is to be as set forth in the following claims.

We claim:

1. A multiple layer drain seal device comprising an upper protective cover layer and a coextensive lower sealing layer capable of forming a liquid impermeable seal when disposed onto a drain grate having apertures, said upper protective cover layer and said lower sealing layer comprising edges and corners, wherein said upper protective cover layer and said lower sealing layer are connected to each other by separate attachment means only adjacent said corners or edges, whereby said lower sealing layer is not coextensively connected to said upper protective layer and the majority of said lower sealing layer is not directly connected to said upper protective cover layer.

2. The device of claim 1, wherein said upper protective cover layer is more durable, harder and less flexible than said lower sealing layer.

3. The device of claim 2, wherein said lower sealing layer has low shear resistance, whereby said lower sealing layer sags into the drain grate apertures, and whereby said upper protective cover layer does not.

4. The device of claim 1, wherein said attachment means are releasable such that said lower sealing layer is completely removable from said upper protective cover layer.

5. The device of claim 1, wherein said attachment means is chosen from the group of attachment means consisting of mechanical fasteners, stitching, adhesive bonding and melt bonding.

6. The device of claim 1, wherein said attachment means connect said upper protective cover layer and said lower sealing layer at discrete points.

7. The device of claim 1, wherein said attachment means connect said upper protective cover layer and said lower sealing layer over small areas.

8. The device of claim 1, wherein said lower sealing layer is composed of polyurethane.

9. The device of claim 1, wherein said upper protective cover layer is composed of polyvinyl chloride.

10. The device of claim 1, further comprising a coextensive intermediate layer, whereby said intermediate layer is not coextensively connected to said upper protective layer or said lower sealing layer and the majority of said intermediate layer is not directly connected to said upper protective cover layer or said lower sealing layer.

11. The device of claim 10, wherein said intermediate layer comprises an envelope containing a filler material.

12. The device of claim 1, wherein said lower sealing layer has a flexibility characterized in that said lower sealing layer will sag at least one sixteenth of an inch when disposed across a three inch opening, and further wherein said lower sealing layer will contact a base surface within three inches when disposed across a raised shoulder three quarter inches above said base surface.

13. The device of claim 1, wherein said lower sealing layer is characterized in that less than 4 grams of 100 grit abrasive particles adhere per square inch when said lower sealing layer is contacted with a coextensive expanse of loose 100 grit abrasive particles.

14. A multiple layer drain seal device comprising an upper protective cover layer and a coextensive lower sealing layer capable of forming a liquid impermeable seal when disposed onto a drain grate having apertures, wherein said upper protective cover layer is more durable, harder and less flexible than said lower sealing layer, said upper protective cover layer and said lower sealing layer comprising edges and corners, wherein said upper protective cover layer and said lower sealing layer are connected to each other by attachment means only adjacent said corners or edges, whereby said upper protective cover layer and said lower sealing layer are not coextensively connected to each other, and wherein said lower sealing layer has low shear resistance, whereby said lower sealing layer sags into the drain grate apertures, and whereby said upper protective cover layer does not.

15. The device of claim 14, wherein said attachment means are releasable such that said lower sealing layer is completely removable from said upper protective cover layer.

16. The device of claim 14, wherein said attachment means is chosen from the group of attachment means consisting of mechanical fasteners, stitching, adhesive bonding and melt bonding.

17. The device of claim 14, wherein said attachment means connect said upper protective cover layer and said lower sealing layer at discrete points.

18. The device of claim 14, wherein said attachment means connect said upper protective cover layer and said lower sealing layer over small areas.

19. The device of claim 14, wherein said lower sealing layer is composed of polyurethane.

20. The device of claim 14, wherein said upper protective cover layer is composed of polyvinyl chloride.

21. The device of claim 14, further comprising a coextensive intermediate layer, whereby said intermediate layer is not coextensively connected to said upper protective layer or said lower sealing layer and the majority of said intermediate layer is not directly connected to said upper protective cover layer or said lower sealing layer.

22. The device of claim 21, wherein said intermediate layer comprises an envelope containing a filler material.

23. The device of claim 14, wherein said lower sealing layer has a flexibility characterized in that said lower sealing layer will sag at least one sixteenth of an inch when disposed across a three inch opening, and further wherein said lower sealing layer will contact a base surface within three inches when disposed across a raised shoulder three quarter inches above said base surface.

24. The device of claim 14, wherein said lower sealing layer is characterized in that less than 4 grams of 100 grit abrasive particles adhere per square inch when said lower sealing layer is contacted with a coextensive expanse of loose 100 grit abrasive particles.

* * * * *